US006521581B1

(12) United States Patent
Hsu et al.

(10) Patent No.: US 6,521,581 B1
(45) Date of Patent: Feb. 18, 2003

(54) WATER-SOLUBLE PACKAGE WITH MULTIPLE DISTINCTLY COLORED LAYERS OF LIQUID LAUNDRY DETERGENT

(75) Inventors: Feng-Lung Gordon Hsu, Tenafly, NJ (US); Kwang H. Lee, Park Ridge, NJ (US); Andre M. Puleo, Garfield, NJ (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 10/017,950

(22) Filed: Dec. 14, 2001

(51) Int. Cl.[7] ..... C11D 1/00; C11D 3/02; C11D 3/14; C11D 17/08

(52) U.S. Cl. ..... 510/297; 510/296; 510/337; 510/340; 510/343; 510/438; 510/523

(58) Field of Search ..... 510/296, 297, 510/337, 340, 343, 438, 523

(56) References Cited

U.S. PATENT DOCUMENTS

| | | | | |
|---|---|---|---|---|
| 2,580,683 | A | 1/1952 | Kreuger | 99/165 |
| 3,277,009 | A | 10/1966 | Freifeld et al. | 252/90 |
| 3,322,674 | A | 5/1967 | Friedman | 252/90 |
| 4,115,292 | A | 9/1978 | Richardson et al. | 252/90 |
| 4,286,016 | A | 8/1981 | Dimond et al. | 428/311 |
| 4,348,292 | A | 9/1982 | Ginn | 252/90 |
| 4,348,293 | A | 9/1982 | Clarke et al. | 252/90 |
| 4,416,791 | A | 11/1983 | Haq | 252/90 |
| 4,610,799 | A | 9/1986 | Wilsberg et al. | 252/90 |
| 4,776,455 | A | 10/1988 | Anderson et al. | 206/0.5 |
| 4,844,828 | A | 7/1989 | Aoki | 252/90 |
| 4,972,017 | A | 11/1990 | Smith et al. | 524/46 |
| 4,973,416 | A | 11/1990 | Kennedy | 252/90 |
| 5,110,640 | A | 5/1992 | Mack | 428/35.2 |
| 5,160,654 | A | 11/1992 | Falou et al. | 252/91 |
| 5,234,615 | A | 8/1993 | Gladfelter et al. | 252/90 |
| 5,316,688 | A | 5/1994 | Gladfelter et al. | 252/90 |
| 5,384,364 | A | 1/1995 | Besse et al. | 252/90 |
| 5,429,874 | A | 7/1995 | VanPutte | 428/522 |
| 5,783,541 | A | 7/1998 | Tack et al. | 510/224 |
| 6,037,319 | A | 3/2000 | Dickler et al. | 510/439 |
| 6,124,036 | A | 9/2000 | Brown et al. | 428/413 |
| 6,133,214 | A | 10/2000 | Jung et al. | 510/296 |
| 6,136,776 | A | 10/2000 | Dickler et al. | 510/439 |
| 6,362,156 | B1 * | 3/2002 | Hsu et al. | 510/418 |

FOREIGN PATENT DOCUMENTS

| | | |
|---|---|---|
| EP | 116 422 | 8/1984 |
| EP | 175 485 | 3/1986 |
| EP | 389 513 | 10/1990 |
| EP | 518 689 | 12/1992 |
| EP | 933 421 | 8/1999 |
| EP | 1067 176 | 1/2001 |
| GB | 1 247 189 | 9/1971 |
| JP | 06/340899 | 12/1994 |
| WO | 89/04282 | 5/1989 |
| WO | 94/14941 | 7/1994 |
| WO | 97/27743 | 8/1997 |
| WO | 99/47635 | 9/1999 |
| WO | 01/60966 | 8/2001 |

OTHER PUBLICATIONS

Abstract of JP 59071673—published Oct. 14, 1982.
Abstract of JP 61207329—published Mar. 12, 1985.
Co–pending application: Williams et al., Ser. No. 09/643, 142; Filed: Aug. 22, 2000.
Co–pending application: Pfeiffer et al., Ser. No. 09/810,106; Filed: Mar. 16, 2001.
Co–pending application: Pfeiffer et al., Ser. No. 09/809,942; Filed: Mar. 16, 2001.
Co–pending application: Hsu et al., Attorney Docket No. C6624(C); Filing Date: Dec. 14, 2001.
Co–pending application: Hsu et al., Attorney Docket No. C6628(C); Filing Date: Dec. 14, 2001.
Co–pending application: Hsu et al., Attorney Docket No. C6629(V); Filling Date: Dec. 14, 2001.

* cited by examiner

*Primary Examiner*—Gregory DelCotto
(74) *Attorney, Agent, or Firm*—Rimma Mitelman

(57) ABSTRACT

The present invention includes a layered liquid detergent composition in a water-soluble single use package, the composition comprising at least two layers, the at least two layers comprising a surfactant, a colored inorganic electrolyte, and water. In the inventive compositions at least one of the layers (the electrolyte layer) is colored. Preferred compositions include a dye in the surfactant layer, so that the compositions contain at least two layers, with two distinct colors. Preferred compositions are transparent and are enclosed within a transparent body.

20 Claims, No Drawings

WATER-SOLUBLE PACKAGE WITH MULTIPLE DISTINCTLY COLORED LAYERS OF LIQUID LAUNDRY DETERGENT

FIELD OF THE INVENTION

A water-soluble single-use package comprising multiple, distinctly colored layers of liquid detergent in the water-soluble body portion and a process of its preparation.

BACKGROUND OF THE INVENTION

Detergent compositions are provided in many forms, of which granular and liquid compositions are the most prevalent. More recently, unit dose forms of detergent have been proposed in the form of compressed tablets of detergent powder or water-soluble packages, which are consumed during a single cleaning application. The unit dose forms are preferred by some consumers, in that the dose is pre-measured and, consequently, the unit dose form is faster, easier and less messy to use. Water-soluble packages filled with liquid detergent composition are desired especially by consumers who are used to liquid detergents.

Water-soluble unit dose packages containing liquids are known. See, for instance, Kennedy (U.S. Pat. No. 4,973,416), Dickler et al. (U.S. Pat. No. 6,037,319), Haq (U.S. Pat. No. 4,416,791) and Richardson (U.S. Pat. No. 4,115,292). The packages may contain various amounts, including relatively high, amounts of water. See for instance WO 94/14941, EP 518 689, WO 97/27743, and JP 06/340,899.

It is sometimes desirable to separate various ingredients of the detergent composition. See for instance WO 01/60966 disclosing a multi-compartment water-soluble pouch. It is also desirable to increase the visual appeal of the package and, also, provide a unique appearance to be associated by consumers with a particular product. In addition, it is desirable to provide a visual signal to a consumer of the presence of special (e.g., benefit) ingredient in the composition.

EP 116422, EP 175485, GB 1247189, WO 99/47635, and Ginn (U.S. Pat. No. 4,348,292) disclose dual layer liquid cleaning compositions in a bottle or a water insoluble package. The layers are achieved by employing an electrolyte, which when added to an aqueous surfactant solution, forces the separation of the surfactant from the aqueous phase. The phenomenon of separating an organic component from an aqueous layer, by the addition of a salt (electrolyte) is known as "salting out." The salt increases the ionic character of water and drives the organic, less polar, component away.

It is desirable to provide a layered liquid detergent composition in a water-soluble single use package. Unfortunately, this presents a problem since bottled layered compositions frequently contain ingredients which would threaten the integrity of the water-soluble package. An especially unique challenge of providing layers of liquid laundry detergent compositions within a water-soluble package is that the integrity of the water soluble package has to be maintained, despite the presence of water in the composition. Furthermore, if layers are desired of different color, a problem exists, since most dyes partition in organic layer. The dyes that partition into an electrolyte layer, do not as a rule do so to the exclusion of the surfactant layer and thus there is a leaking of color into the surfactant layer.

SUMMARY OF THE INVENTION

The present invention includes a layered liquid detergent composition in a water-soluble single use package, the composition comprising at least two layers, with a surfactant, a transition metal inorganic electrolyte, water and optionally other ingredients distributed within the layers. The inventive compositions include water, yet the water-soluble package remains intact on storage.

The following detailed description and the examples illustrate some of the effects of the inventive compositions. The invention and the claims, however, are not limited to the following description and examples.

DETAILED DESCRIPTION OF THE INVENTION

Except in the operating and comparative examples, or where otherwise explicitly indicated, all numbers in this description indicating amounts of material or conditions of reaction, physical properties of materials and/or use are to be understood as modified by the word "about." All amounts are by weight of the liquid detergent composition, unless otherwise specified.

It should be noted that in specifying any range of concentration, any particular upper concentration can be associated with any particular lower concentration.

For the avoidance of doubt the word "comprising" is intended to mean "including" but not necessarily "consisting of" or "composed of." In other words, the listed steps or options need not be exhaustive.

"Water-soluble body" as used herein means soluble in cold water, i.e. soluble at 5° C. and above.

"Liquid" as used herein means that a continuous phase or predominant part of the composition is liquid and that a composition is flowable at 20° C.

"Colored inorganic electrolyte" as used herein means an electrolyte containing a transition metal cation, which in aqueous solution produces color.

"Transparent" as used herein includes both transparent and translucent and means that an ingredient, or a mixture, or a phase, or a composition, or a package according to the invention preferably has a transmittance of more than 25%, more preferably more than 30%, most preferably more than 40%, optimally more than 50% in the visible part of the spectrum (approx. 410–800 nm). Alternatively, absorbency may be measured as less than 0.6 (approximately equivalent to 25% transmitting) or by having transmittance greater than 25% wherein % transmittance equals: $1/10^{absorbancy} \times 100\%$. For purposes of the invention, as long as one wavelength in the visible light range has greater than 25% transmittance, it is considered to be transparent/translucent.

The term "composition" or "liquid detergent composition" as used herein means the final detergent composition (i.e., the detergent composition itself, but not the water-soluble body), including at least two layers. The at least two layers comprise between them a surfactant, a colored inorganic electrolyte, water and any optional ingredients described below.

WATER-SOLUBLE BODY PORTION

The package is preferably made of a clear, sealable, cold water soluble film such as polyvinyl alcohol. Thickness could range from 25 to 100 $\mu$m, more preferably from 35 to 80 $\mu$m, most preferably from 45 to 55 $\mu$m. Other materials from which the package can be made include but are not limited to methyl hydroxy propyl cellulose and polyethylene oxide. Polyvinyl alcohol is preferred due to its ready availability and low cost. One supplier of polyvinyl alcohol film is Monosol Inc. European suppliers of suitable films include but are not limited to Monosol supplied by Monosol Inc. or PT supplied by Aicello or K-series supplied by Kurary or Hydrafilm supplied by Rainier Specialty polymers ltd, or QSA series by Polymer Films, Inc.

Preferably the water-soluble film of the base wall is the same material as that used to make the body wall. Both thermoforming and cold forming (e.g., with water) are possible.

DETERGENT COMPOSITION

The essential ingredients of the inventive laundry compositions are surfactant, a colored inorganic electrolyte and water.

Surfactant

The compositions of the invention contain one or more surface active agents (surfactants) selected from the group consisting of anionic, nonionic, cationic, ampholytic and zwitterionic surfactants or mixtures thereof. The preferred surfactant detergents for use in the present invention are mixtures of anionic and nonionic surfactants although it is to be understood that any surfactant may be used alone or in combination with any other surfactant or surfactants. The surfactant should comprise at least 5%, e.g., 5% to 80%, preferably at least 10% to 80%, more preferably 15% to 40%; even more preferably 15% to 35% of the composition.

Nonionic Surfactant

Nonionic synthetic organic detergents which can be used with the invention, alone or in combination with other surfactants, are described below. Nonionic surfactants are typically included.

Preferred nonionic surfactants are nonionic surfactants which are pourable liquids, gels or pastes at 25° C. Nonionic detergent surfactants normally have molecular weights of from about 300 to about 11,000. Mixtures of different nonionic detergent surfactants may also be used, provided the mixture is a liquid gel or paste at 25° C. Optionally, the composition may comprise one or more nonionic surfactants which are solid at 25° C. These dissolved and/or dispersed in either or both liquid layers.

As is well known, the nonionic detergents are characterized by the presence of an organic hydrophobic group and an organic hydrophilic group and are typically produced by the condensation of an organic aliphatic or alkyl aromatic hydrophobic compound with ethylene oxide (hydrophilic in nature). Typical suitable nonionic surfactants are those disclosed in U.S. Pat. Nos. 4,316,812 and 3,630,929 and applicants published European specification EP-A-225,654.

Usually, the nonionic detergents are polyalkoxylated lipophiles wherein the desired hydrophile-lipophile balance is obtained from addition of a hydrophilic polyalkoxy group to a lipophilic moiety. A preferred class of nonionic detergent is the alkoxylated alkanols wherein the alkanol is of 9 to 18 carbon atoms and wherein the number of moles of alkylene oxide (of 2 or 3 carbon atoms) is from 3 to 12. Of such materials it is preferred to employ those wherein the alkanol is a fatty alcohol of 9 to 11 or 12 to 15 carbon atoms and which contain from 5 to 8 or 5 to 9 alkoxy groups per mole.

Exemplary of such compounds are those wherein the alkanol is of 12 to 15 carbon atoms and which contain about 7 ethylene oxide groups per mole, e.g. Neodol® 25-7 and Neodol® 23®-6.5, which products are made by Shell Chemical Company, Inc. The former is a condensation product of a mixture of higher fatty alcohols averaging about 12 to 15 carbon atoms, with about 7 moles of ethylene oxide and the latter is a corresponding mixture wherein the carbon atoms content of the higher fatty alcohol is 12 to 13 and the number of ethylene oxide groups present averages about 6.5. The higher alcohols are primary alkanols.

Other useful nonionics are represented by the commercially well-known class of nonionics sold under the trademark Plurafac®. The Plurafacs® are the reaction products of a higher linear alcohol and a mixture of ethylene and propylene oxides, containing a mixed chain of ethylene oxide and propylene oxide, terminated by a hydroxyl group. Examples include $C_{13}$–$C_{15}$ fatty alcohol condensed with 6 moles ethylene oxide and 3 moles propylene oxide, $C_{13}$–$C_{15}$ fatty alcohol condensed with 7 moles propylene oxide and 4 moles ethylene oxide, $C_{13}$–$C_{15}$ fatty alcohol condensed with 5 moles propylene oxide and 10 moles ethylene oxide, or mixtures of any of the above.

Another group of liquid nonionics are commercially available from Shell Chemical Company, Inc. under the Dobanol® trademark: Dobanol® 91-5 is an ethoxylated $C_9$–$C_{11}$ fatty alcohol with an average of 5 moles ethylene oxide and Dobanol® 23-7 is an ethoxylated $C_{12}$–$C_{13}$ fatty alcohol with an average of 7 moles ethylene oxide per mole of fatty alcohol.

In the compositions of this invention, preferred nonionic surfactants include the $C_{12}$–$C_{15}$ primary fatty alcohols with relatively narrow contents of ethylene oxide in the range of from about 7 to 9 moles, and the $C_9$ to $C_{11}$ fatty alcohols ethoxylated with about 5–6 moles ethylene oxide.

Another class of nonionic surfactants which can be used in accordance with this invention are glycoside surfactants. Glycoside surfactants suitable for use in accordance with the present invention include those of the formula:

$$RO—R'O_y—(Z)_x.$$

wherein R is a monovalent organic radical containing from about 6 to about 30 (preferably from about 8 to about 18) carbon atoms; R' is a divalent hydrocarbon radical containing from about 2 to 4 carbons atoms; 0 is an oxygen atom; y is a number which can have an average value of from 0 to about 12 but which is most preferably zero; Z is a moiety derived from a reducing saccharide containing 5 or 6 carbon atoms; and x is a number having an average value of from 1 to about 10 (preferably from about 1.5 to about 10).

A particularly preferred group of glycoside surfactants for use in the practice of this invention includes those of the formula above in which R is a monovalent organic radical (linear or branched) containing from about 6 to about 18(especially from about 8 to about 18) carbon atoms; y is zero; z is glucose or a moiety derived therefrom; x is a number having an average value of from 1 to about 4 (preferably from about 1 to 4).

Nonionic surfactants particularly useful for this application include, but are not limited to: alcohol ethoxylates (e.g. Neodol® 25-9 from Shell Chemical Co.), alkyl phenol ethoxylates (e.g. Tergitol® NP-9 from Union Carbide Corp.), alkylpolyglucosides (e.g. Glucapon® 600CS from Henkel Corp.), polyoxyethylenated polyoxypropylene glycols (e.g. Pluronic(® L-65 from BASF Corp.), sorbitol esters (e.g. Emsorb® 2515 from Henkel Corp.), polyoxyethylenated sorbitol esters (e.g. Emsorb® 6900 from Henkel Corp.), alkanolarnides (e.g. Alkarnide® DC212/SE from Rhone-Poulenc Co.), and N-alkypyrrolidones (e.g. Surfadone® LP-100 from ISP Technologies Inc.).

Mixtures of two or more of the nonionic surfactants can be used.

Anionic Surfactant

Anionic surface active agents which may be used in the present invention are those surface active compounds which contain a long chain hydrocarbon hydrophobic group in their molecular structure and a hydrophilic group, i.e.; water solubilizing group such as sulfonate, sulfate or carboxylate group. The anionic surface active agents include the alkali metal (e.g. sodium and potassium) water soluble higher alkyl benzene sulfonates, alkyl sulfonates, alkyl sulfates and the alkyl polyether sulfates. They may also include fatty acid or fatty acid soaps. The preferred anionic surface active agents are the alkali metal, ammonium or alkanolamide salts of higher alkyl benzene sulfonates and alkali metal, ammonium or alkanolamide salts of higher alkyl sulfonates. Preferred higher alkyl sulfonates are those in which the alkyl groups contain 8 to 26 carbon atoms, preferably 12 to 22 carbon atoms and more preferably 14 to 18 carbon atoms. The alkyl group in the alkyl benzene sulfonate preferably contains 8 to 16 carbon atoms and more preferably 10 to 15 carbon atoms. A particularly preferred alkyl benzene sulfonate is the sodium or potassium dodecyl benzene sulfonate, e.g. sodium linear dodecyl benzene sulfonate.

The primary and secondary alkyl sulfonates can be made by reacting long chain alpha-olefins with sulfites or bisulfites, e.g. sodium bisulfite. The alkyl sulfonates can also be made by reacting long chain normal paraffin hydrocarbons with sulfur dioxide and oxygen as described in U.S. Pat. Nos. 2,503,280, 2,507,088, 3,372, 188 and 3,260,741 to obtain normal or secondary higher alkyl sulfonates suitable for use as surfactant detergents.

The alkyl substituent is preferably linear, i.e. normal alkyl, however, branched chain alkyl sulfonates can be employed, although they are not as good with respect to biodegradability. The alkane, i.e. alkyl, substituent may be terminally sulfonated or may be joined, for example, to the carbon atom of the chain, i.e. may be a secondary sulfonate. It is understood in the art that the substituent may be joined to any carbon on the alkyl chain. The higher alkyl sulfonates can be used as the alkali metal salts, such as sodium and potassium. The preferred salts are the sodium salts. The preferred alkyl sulfonates are the $C_{10}$ to $C_{18}$ primary normal alkyl sodium and potassium sulfonates, with the $C_{10}$ to $C_{15}$ primary normal alkyl sulfonate salt being more preferred.

Mixtures of higher alkyl benzene sulfonates and higher alkyl sulfonates can be used as well as mixtures of higher alkyl benzene sulfonates and higher alkyl polyether sulfates.

Also normal alkyl and branched chain alkyl sulfates (e.g., primary alkyl sulfates) may be used as the anionic component).

The higher alkyl polyether sulfates used in accordance with the present invention can be normal or branched chain alkyl and contain lower alkoxy groups which can contain two or three carbon atoms. The normal higher alkyl polyether sulfates are preferred in that they have a higher degree of biodegradability than the branched chain alkyl and the lower poly alkoxy groups are preferably ethoxy groups.

The preferred higher alkyl poly ethoxy sulfates used in accordance with the present invention are represented by the formula:

$$R'—O(CH_2\ CH_2\ O)_p—SO_3\ M,$$

where R' is $C_8$ to $C_{20}$ alkyl, preferably $C_{10}$ to $C_{18}$ and more preferably $C_{12}$ to $C_{15}$; p is 2 to 8, preferably 2 to 6, and more preferably 2 to 4; and M is an alkali metal, such as sodium and potassium, or an ammonium cation. The sodium and potassium salts are preferred.

A preferred higher alkyl poly ethoxylated sulfate is the sodium salt of a triethoxy $C_{12}$ to $C_{15}$ alcohol sulfate having the formula:

$$C_{12\text{-}15}—O—(CH_2\ CH_2\ O)_3—SO_3\ Na$$

Examples of suitable alkyl ethoxy sulfates that can be used in accordance with the present invention are $C_{12\text{-}15}$ normal or primary alkyl triethoxy sulfate, sodium salt; n-decyl diethoxy sulfate, sodium salt; $C_{12}$ primary alkyl diethoxy sulfate, ammonium salt; $C_{12}$ primary alkyl triethoxy sulfate, sodium salt: $C_{15}$ primary alkyl tetraethoxy sulfate, sodium salt, mixed $C_{14\text{-}15}$ normal primary alkyl mixed tri- and tetraethoxy sulfate, sodium salt; stearyl pentaethoxy sulfate, sodium salt; and mixed $C_{10\text{-}18}$ normal primary alkyl triethoxy sulfate, potassium salt.

The normal alkyl ethoxy sulfates are readily biodegradable and are preferred. The alkyl poly-lower alkoxy sulfates can be used in mixtures with each other and/or in mixtures with the above discussed higher alkyl benzene, alkyl sulfonates, or alkyl sulfates.

The alkali metal higher alkyl poly ethoxy sulfate can be used with the alkylbenzene sulfonate and/or with an alkyl sulfonate or sulfonate, in an amount of 0 to 70%, preferably 10 to 50% and more preferably 10 to 20% by weight of entire composition.

Anionic surfactants particularly useful for this application include, but are not limited to: linear alkyl benzene sulfonates (e.g. Vista® C-500 from Vista Chemical Co.), alkyl sulfates (e.g. Polystep® B-5 from Stepan Co.), polyoxyethylenated alkyl sulfates (e.g. Standapol® ES-3 from Stepan Co.), alpha olefin sulfonates (e.g. Witconate® AOS from Witco Corp.), alpha sulfo methyl esters (e.g. Alpha-Step® MC-48 from Stepan Co.), alkyl ether sulfates and isethionates (e.g. Jordapon® Cl from PPG Industries Inc.).

Anionic surfactants may be added pre-neutralized or, preferably, may be formed in situ, by neutralizing a precursor acid (fatty acid in the case of soaps). Further, the anionic precursor or fatty acid should be over-neutralised (i.e. there should be an excess of the alkaline material used to form the counter-ion). Inorganic salt, preferably, sodium or potassium salt of the anionic precursor acid is preferred to improve detergency, but organic salt results in improved transparency.

Cationic Surfactants

Many cationic surfactants are known in the art, and almost any cationic surfactant having at least one long chain alkyl group of about 10 to 24 carbon atoms is suitable in the present invention. Such compounds are described in "Cationic Surfactants", Jungermann, 1970, incorporated by reference.

Specific cationic surfactants which can be used as surfactants in the subject invention are described in detail in U.S. Pat. No. 4,497,718, hereby incorporated by reference.

As with the nonionic and anionic surfactants, the compositions of the invention may use cationic surfactants alone or in combination with any of the other surfactants known in the art. Of course, the compositions may contain no cationic surfactants at all.

Amphoteric Surfactants

Ampholytic synthetic detergents can be broadly described as derivatives of aliphatic or aliphatic derivatives of heterocyclic secondary and tertiary amines in which the aliphatic radical may be a straight chain or a branched and wherein one of the aliphatic substituents contains from about 8 to 18 carbon atoms and at least one contains an anionic water-solubilizing group, e.g. carboxylate, sulfonate, sulfate. Examples of compounds falling within this definition are sodium 3(dodecylamino)propionate, sodium 3-(dodecylamino)propane-1-sulfonate, sodium 2-(dodecylamino)ethyl sulfate, sodium 2-(dimethylamino) octadecanoate, disodium 3-(N-carboxymethyldodecylamino)propane 1-sulfonate, disodium octadecyl- imminodiacetate, sodium 1-carboxymethyl-2-undecylimidazole, and sodium N, N-bis (2-hydroxyethyl)-2-sulfato-3-dodecoxypropylamine. Sodium 3-(dodecylamino)propane-l-sulfonate is preferred.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent containing an anionic water solubilizing group, e. g., carboxy, sulfonate, sulfate, phosphate, or phosphonate.

Specific examples of zwitterionic surfactants which may be used are set forth in U.S. Pat. No. 4,062,647, hereby incorporated by reference.

Preferably, the surfactant in the laundry compositions of the invention is anionic and/or nonionic, especially linear alkylbenzene sulfonate, alkyl ether sulfate, alcohol ethoxylates and mixtures thereof.

For higher foaming formulations (top-loading washing machines), mixtures of anionic and nonionic surfactants are especially preferred, for optimum greasy stain and particulate soil removal. When mixtures are used, the most effective mixtures employ anionic to nonionic ratio of from 10: 1 to 1:10, preferably from 5:1 to 1:5, most preferably from 3:1 to 1:3.

When low foaming formulations are desired, e.g., for front-loading machines, nonionic surfactants are employed, in the absence of, or lower levels of, anionic surfactants, alone or in combination with cationic surfactants and/or antifoams.

Electrolyte

The electrolyte employed in the present invention contains a transition metal cation, such that the electrolytes (salts) containing such cations will produce a colored aqueous solution. Suitable cations include, but are not limited to cobalt, copper (cuprous and cupric), chrome, nickel, iron (ferric and ferrous), zinc, zinc, manganese, vanadium (vanadyl), palladium and cadmium.

Suitable anions include but are not limited to sulphate, nitrate, fluoride, chloride, bromide, iodide, acetate, tartrate, ammonium tartrate, benzenesulphonate, benzoate, bicarbonate, carbonate, bisulphate, bisulphite, sulphate, sulphite, borate, borotartrate, bromate, butyrate, chlorate, camphorate, chlorite, cinnamate, citrate, disilicate, dithionate, ethylsulphate, ferricyanide, ferrocyanide, fluorosilicate, formate, glycerophosphate, hydrogenphosphate, hydroxostannate, hypochlorite, hyponitrite, hypophosphite, iodate, isobutyrate, lactate, laurate, metaborate, metasilicate, methionate, methylsulphate, nitrite, oleate, orthophosphate, orthophosphite, orthosilicate, oxalate, perborate, perchlorate, phosphate, polyfluoride, polychloride, polyiodide, polybromide, polysulphide, polysulphate, polysulphite, salicylate, silicate, sorbate, stannate, stearate, succinate or valerate, dichromate, chromate, nitrate, throyonate, permanganate, bromide, chloride, fluoride, gluconate, phenolsulfate, selenate.

It has been found, as part of the present invention, that the use of the colored inorganic electrolyte results in formulations which contain a colored electrolyte layer, with the color not leaking into the surfactant layer. Furthermore, it is possible to have stable multi-colored formulations, with the colored inorganic electrolyte in the electrolyte layer, and an organic dye in the surfactant layer.

Suitable electrolytes include but are not limited to the following:

| Compound | Color |
|---|---|
| Nickel Sulfate | Green |
| Cupric Sulfate | Blue |
| Potassium Dichromate | Orange-red |
| Ammonium Chromate | Yellow |
| Ammonium Chromic Sulfate | Purple-red |
| Tetraamminecopper Sulfate | Blue |
| Ammonium Ferric Sulfate | Pale violet |
| Chromic Potassium Sulfate | Purple-red |
| Ferric Sulfate | Light yellow |
| Ferrous Sulfate | Brown-green |
| Cobaltous Sulfate | Red-pink |
| Cobaltous Potassium Sulfate | Purple |
| Manganese Sulfate | Red-pink |
| Vanadyl Sulfate | Blue |
| Manganese Nitrate | Pink-ish |
| Ammonium Ferric Citrate | Green-brown |
| Ferric Nitrate | Purple-white |
| Ferric Sulfate | Yellowish |
| Cobaltous Throyonate | Blue-green |
| Merbromin | Red |
| Zinc Permanganate | Violet-brown |
| Ammonium Nickel Sulfate | Blue-green |
| Nickel Acetate | Green |
| Nickel Bromide | Yellow-green |
| Nickel Chloride | Green |
| Nickel Fluoride | Yellow-green |
| Potassium Tetracyanonickelate | Orange |
| Ammonium Cupric Chloride | Yellow |
| Cupric Acetate | Green |
| Cupric Chloride | Blue-green |
| Cupric Formate | Pale blue |
| Cupric Gluconate | Light blue |
| Cupric Glycinate | Light blue |
| Cupric Nitrate | Pale green |
| Cupric Perchlorite | Pale green |
| Cupric Phenolsulfate | Blue-green |
| Cupric Salicylate | Blue-green |
| Cupric Selenate | Green-blue |
| Cupric Tatrate | Dark green |
| Cuproxoline | Brown |
| Palladium Chloride | Brown |
| Cadmium Sulfide | Yellow-orange |

Mixtures of electrolytes may be employed.

Electrolyte may be pre-formed or formed in situ. Electrolytes may be anhydrous or partially or fully hydrated (bound water).

Preferably, the colored inorganic electrolytes suitable for use in the present invention meet both of the following criteria:

(1) they have a high salting out ability;

(2) they are able to lower water activity.

Preferred electrolytes are selected from the group consisting of nickel, cupric and cobaltous salts of sulfate and chloride, because these result in the most pleasing colors for a laundry detergent.

The liquid detergent composition of the invention generally includes from 5 to 50%, more preferably from 10 to 40%, most preferably from 5 to 35% of the colored inorganic electrolyte, in order to attain a stable layered composition, at optimum cost. The concentration of electrolyte to create a two-layered composition depends on the surfactant concentration, the water amount and the identity of the electrolyte. The concentration needed may be predicted by calculating the ionic strength of the electrolyte at a particular concentration. It has been found as part of the present invention that the preferred electrolytes and preferred concentrations are those that have a calculated ionic strength of at least 4.2, preferably at least 4.4, more preferably at least 5.

Ionic strength represents interactions of ions with water molecules and other ions in the solution. Ionic strength may be calculated as follows:

$$I=\frac{1}{2}\Sigma Z_i^2 m_j$$

Σ=a sum for i number of ions

I=ionic strength z=valence factor m=molal concentration of the ith ion concentration In the preferred embodiment, in order to control the intensity of the color and to further lower the cost, the colored inorganic electrolyte is employed at lower concentrations, just sufficient to deliver the desired color. Such lower concentrations, however, might not be sufficient to achieve the separation of layers—which function is accomplished by an additional inorganic or organic electrolyte. When mixtures of the colored inorganic electrolyte are employed with additional inorganic or organic electrolytes, the amount of the colored inorganic electrolyte is in the range of from 0.001 to 10%, preferably from 0.01 to 5%, more preferably from 0.05 to 5%, optimally from 0.5 to 3%, while the total amount of all the electrolyte is from 1 to 50%, more preferably from 5 to 40%, most preferably from 5 to 35%, and optimally from 10 to 30%. Again, the ionic strength calculation may be usefully applied to mixtures of electrolytes, to determine the total concentration of the electrolyte necessary to achieve the separation of the layers.

"Organic electrolyte" as used herein means an electrolyte containing an organic cation. "Organic cation," in turn, means a non-metal, positively charged ionic entity. Suitable organic cations include but are not limited to ammonium, ammonium hydroxide, amines, more preferably alkanolamines (e.g., monoethanolamine, diethanolamine, triethanolamine, isopropylamine). Preferred organic electrolytes are selected from the group consisting of monoethanolamine, triethanolamine, and ammonium oxide salts of citrate, carbonate, bicarbonate, borate and sulfate. Monoethanolamine salt is the most effective. Monoethanolamine citrate, monoethanolamine carbonate and monoethanolamine borate are the most preferred, due to their ability to also function as builders and/or buffering agents in the detergent composition. Monoethanolamine citrate is optimum, due to its optimum ability to salt out a surfactant and/or reduce the water activity.

"Additional inorganic electrolyte" as used herein means an electrolyte containing an alkali or alkaline earth metal cation. Suitable additional inorganic electrolytes include but are not limited to sodium, potassium, lithium, magnesium, and calcium salts. Preferred electrolytes are selected from the group consisting of sodium and potassium salts of citrate, carbonate, bicarbonate, borate and sulfate. Sodium salt is the most cost-effective. Sodium citrate, sodium carbonate and sodium borate are the most preferred, due to their ability to also function as builders and/or buffering agents in the detergent composition. Sodium citrate is optimum, due to its optimum ability to salt out a surfactant and/or reduce the water activity.

Suitable anions for the additional inorganic electrolyte and the organic electrolyte are selected from the list above.

When the colored inorganic electrolyte is the sole electrolyte employed, it may be necessary to pre-dissolve the electrolyte in heated water or to heat the formulation, in order to attain the layer separation.

Water

The liquid detergent compositions of the invention may (but do not have to) contain significant amounts of water. The inclusion of water is beneficial, in order to incorporate hydrophilic ingredients into the composition. By virtue of employing the inorganic electrolyte as taught herein, the layered composition is attained which may contain high amounts of water, yet the water present in the composition does not dissolve the water-soluble package enveloping the composition.

The liquid detergent composition of the invention generally includes from 1 to 70% of total (free and bound) water, preferably from 5 to 70%, more preferably from 5 to 50%, most preferably from 10 to 50%, and optimally from 25 to 40%, in order to obtain clarity and ease of the dispersion of the composition during use (% by weight of the composition). Yet, by virtue of employing the electrolyte as taught herein the water activity of the inventive compositions is generally low: typically less than 0.94, preferably less than 0.93, more preferably less than 0.9, optimally less than 0.8, in order to obtain compositions which contain optimum amounts of water, yet may be stored safely in a water-soluble package.

Measurement of Water Activity

Water activity (Aw) is the ratio of the vapor pressure of a solution to that of pure water. It is related to the inverse of the relative humidity of the atmosphere above the sample at equilibrium.

Apparatus: Aqualab CX-2 Water Activity meter; Sample containers; Transfer pipets.

| Water Activity Standards and Values | |
|---|---|
| Lithium chloride (LiCl) | 0.113 +/− 0.003 |
| Magnesium chloride (MgCl2) | 0.328 +/− 0.002 |
| Sodium chloride (NaCl) | 0.753 +/− 0.001 |
| Potassium chloride (KCl) | 0.843 +/− 0.003 |
| Potassium sulfate (K2SO4) | 0.973 +/− 0.005 |
| Deionized water | 1.000 +/− 0.003 |

Preparation of Salt Standards

1. Salt standards should be prepared in deionized water every six months, or as to needed. They are stored at room temperature, and are used to calibrate the water activity machine with each use.
2. A super-saturated solution must be made of each salt.
3. To prepare a super-saturated solution, keep adding salt crystals to deionized water, shaking well, until there is undissolved salt at the bottom of the jar.
4. Keep the salt solutions at room temperature overnight to reach equilibrium.
5. If salt remains undissolved at the bottom of the jar, a super-saturated solution has been reached. If all of the salt is dissolved, repeat steps 3 and 4.

Aqualab Procedure to Measure Water Activity

1. The Aqualab measures the inverse of the relative humidity of a solution, by evaluating the condensation that forms on a mirror within the machine. Samples containing high levels of propylene glycol are not usually run with the Aqualab because PPG coats the mirror.
2. Turn on the machine so that it can warm up for at least one hour prior to use.
3. Test all samples and standards in duplicate.
4. The Aqualab must be standardized before samples are run. Deionized water should always be evaluated at the beginning of the run. Chose the appropriate salt solutions that are closest to the projected Aw of the test sample, so that the sample's value is bracketed with standards. After the standards are run, the test samples are evaluated.

5. Use a transfer pipet to add the sample to the sample containers. The containers should only be filled halfway. Load the container in the sleeve of the Aqualab, and push in the sleeve.
6. Turn the Aqualab dial from the upright position ("open/load") to the left position ("read") to start reading the sample.
7. When the sample is finished (within a few minutes), the machine will beep until the dial is turned back to the upright position. Record the Aw and the temperature.
8. Every 6–8 samples, new standards should be run. In addition, standards should be run after the last sample to ensure that the machine remained calibrated.

Note: the Aqualab variability is +/−0.0003 units.

LAYERS

The liquid laundry detergent according to the invention comprises at least two layers. Both layers are preferably isotropic (a single phase when viewed macroscopically), after standing still for at least 24 hours at 20° C. "Isotropic" is used herein to describe each layer of the inventive composition, since the composition overall contains at least two layers and thus could not be isotropic overall.

Both layers are preferably transparent/translucent. At least one layer (the electrolyte layer) is colored. Generally, the layers are attained when the sufficient amount of the electrolyte is added to the surfactant. The amount differs in each specific case, depending on the identity and the amount of the surfactant(s), water and electrolyte(s). The discussion of ionic strength above is relevant here, since the electrolyte should be present in a sufficient concentration to force surfactant salting out, thus creating layers.

Preferred compositions comprise two layers, with the top layer containing majority, preferably all, of the surfactant, and the bottom layer containing the majority, preferably all, of the electrolyte.

When shaken, the layers within the composition coalesce. Yet, they separate into visible layers, with each layer regaining its clarity, upon standing for at most 24 hours at 20° C.

It should be noted that in the final composition, the compositions of the resultant layers do not necessarily correspond with the compositions of the respective layers prior to their being combined into a single composition. This is because of reaction between ingredients, in particular the acidic ingredients and the basic ingredients (e.g., sodium hydroxide) and also, because of possible migration of material between the two layers, or emulsification of some of the layers within each other. Consequently, it is to be understood that the composition of the components as herein described pertains to the compositions prior to their being combined into a single composition. By virtue of employing a surfactant and an electrolyte in the amounts as herein described (and optional ingredients, including those described below), the composition separates into at least two layers, wherein the composition of the layers may differ from the composition of the initial components.

Generally the ranges of the surfactant, electrolyte, and water content within either the respective components or the layers are as follows (% by weight of the relevant component):

| | Surfactant | Electrolyte | Total Water |
|---|---|---|---|
| Surfactant Component or Layer | | | |
| General | 5–100 | 0–15 | 0–60 |
| Preferred | 10–70 | 0–5 | 1–40 |
| Most Preferred | 20–60 | 0–1 | 5–30 |
| Optimum | 20–55 | 0–1 | 5–25 |
| Electrolyte Component or Layer | | | |
| General | 0–5 | 1–99 | 1–90 |
| Preferred | 0–1 | 5–95 | 10–60 |
| Most Preferred | 0–1 | 10–60 | 20–70 |
| Optimum | 0–1 | 15–40 | 20–50 |

The volume ratio of the two components in the final composition is generally in the range of from 10:90 to 90:10, more preferably from 20:80 to 80:20, most preferably from 70:30 to 30:70, and optimally from 40:60 to 60:40, in order to provide the most pleasing appearance and optimum cleaning benefits. The resulting layers have the volume ratios in the same ranges as described above (but the layer ratio may not be the same as the starting component ratio). More than two layers may be present. The additional layer may be a capsule, dispersion or emulsion layer, as described below under Optional Ingredients. Also possible is that a surfactant component may include both highly polar and highly non-polar ingredients, which might separate into more than one organic-rich layer.

OPTIONAL INGREDIENTS

Hydrotrope

A particularly preferred optional ingredient is a hydrotrope, which prevents liquid crystal formation. The addition of the hydrotrope thus aids the clarity/transparency of the composition. The hydrotrope is typically included in the surfactant layer. Suitable hydrotropes include but are not limited to propylene glycol, ethanol, urea, salts of benzene sulphonate, toluene sulphonate, xylene sulphonate or cumene sulphonate. Suitable salts include but are not limited to sodium, potassium, ammonium, monoethanolamine, triethanolamine. Preferably, the hydrotrope is selected from the group consisting of propylene glycol, xylene sulfonate, ethanol, and urea to provide optimum performance. The amount of the hydrotrope is generally in the range of from 0 to 30%, preferably from 0.5 to 20%, most preferably from 1 to 15%.

Dye

Another particularly preferred ingredient is a dye, in order to create a composition with at least two visually appealing colored layers. Typically, a dye is an organic molecule and so will partition into the organic (surfactant) layer. It is possible, although less usual that a dye may partition into the electrolyte layer, but the dyes that partition into the surfactant layer are preferred. This is because a dye that partitions into an electrolyte layer will still partially partition (or leak into) the surfactant layer. By virtue of employing a colored inorganic electrolyte in the inventive compositions, a two-colored composition may be attained, with the dye in the surfactant layer.

Suitable dyes include but are not limited to:

| Family Structure |
|---|
| Acridine |
| Acridone (including Anthraquinone and Pyrene) |
| Arylmethane |
| Azo |
| Diazonium |
| Nitro |
| Phthalocyanine |
| Quinone Imine |
| Tetrazolium |
| Thiazole |
| Xanthene |

Of these, the Azo and Pyrene families of dyes are less preferred, because these dyes will likely partition into both layers (leak). The inventive compositions generally include from 0.0001 to 1%, more preferably from 0.0005 to 0.1%, most preferably from 0.0001 to 0.1% of the dye, in order to provide a pleasing appearance (% by weight of the composition).

Following dyes will most likely partition in the surfactant layer, regardless of the component to which they are added. These dyes have a direct affinity for the surfactant or organic type layer.

| Vendor | Color Common Name | Chemical Family |
|---|---|---|
| Warner Jenkinson | D&C red 33 | Monoazo |
| Tricon Colors | D&C violet 2 | Anthraquinone |
| Clariant Corporation | Acid blue 80 | Anthraquinone |

Relatively, the following dyes will partition into both layers:

| Vendor | Color Common Name | Chemical Family |
|---|---|---|
| Clariant Corporation | Acid yellow 17 powder | Azo Dye |
| Kohnstamm | D&C green 8 | Pyrene |

Capsules

The liquid compositions may include encapsulated ingredients, preferably in the form of transparent or colored capsules or an emulsion, or a dispersion. These capsules, emulsion, or dispersion, may be distributed in one or more layers of the inventive compositions, or may be present as an additional layer. Preferred ingredients to be encapsulated are enzymes, bleaches, colorants, perfumes, and mixtures thereof to minimize the damage to these ingredients from water or surfactant, or alkaline ingredients, and/or to enhance the appearance of the product. Preferred inventive compositions comprise from 0.5 to 20%, more preferably from 0.1 to 10%, most preferably from 0.3 to 6%, and optimally from 0.5 to 5%, in order to attain optimum performance and/or appearance (% by weight of the composition).

The preferred laundry composition may further include one or more well-known laundry ingredients, such as builders (from 0.1 to 20%), anti-redeposition agents, fluorescent dyes, perfumes, soil-release polymers, colorant, enzymes, buffering agents, antifoam agents, UV-absorber, etc. Electrolytes may serve as builders in the composition, yet additional builders may be present.

The pH of the inventive compositions is generally in the range of from 2.5 to 12.5, preferably in the range of from 4 to 10, most preferably from 6 to 9, in order to attain optimum laundry cleaning.

Preferably, the detergent composition is a transparent/translucent two-colored composition packaged in the transparent/translucent body.

The packages of the invention may be prepared from polyvinyl alcohol film, or other suitable material, which is filled, then sealed, preferably heat-sealed or water-sealed.

The packages may be filled in any suitable way. Preferably, the liquid detergent composition is pre-mixed (both components) and filled in the same manner as a single phase composition would be. The composition may also be filled component by component.

The package may take many shapes as viewed in a plan view, such as rectangular, square, triangle, round, etc. In one preferred embodiment, the package is in a polyhedral shape (e.g., tetrahedron or a pyramid).

In use, the package is mixed with water (e.g., inside a laundry machine), in order to dissolve the body and to release the contents of the package.

The following specific examples further illustrate the invention, but the invention is not limited thereto.

EXAMPLE 1

A composition as in Table 1, within the scope of the invention, was prepared by mixing the ingredients in the order listed for each component.

TABLE 1

| Raw Material | % by weight of the component |
|---|---|
| Surfactant Component | |
| Sodium Xylene Sulfonate | 10.33 |
| Propylene Glycol | 6.20 |
| Alcohol Ethoxylate, Neodol ® 25-9 | 16.55 |
| Sodium Linear Alkyl Sulfonate | 18.90 |
| Sodium Ethoxylated Alcohol Sulfate (59.39%) | 16.55 |
| Miscellaneous | 0.72 |
| 1% Acid Blue 80 | 0~2.0 |
| Water | to 100% |
| Electrolyte component | |
| Cupric Sulfate Pentahydrate | 22.66 |
| Water | To 100% |
| Ionic Strength | 4.26 |

In the composition above, cupric sulfate pentahydrate did not initially dissolve. The composition was heated to 90°C., resulting in the dissolution of cupric sulfate and the separation of the composition into two layers, with the top layer being light blue and the bottom layer turquoise in color.

Twenty five grams of each layers were packed and heat-sealed in a PVA pouch made of MonoSol M-4045 PVA film. Two phases in the pouch were clearly visible. After storage at 25° C. for a month, the two phases was still stable and visible and the pouch was still in a good condition.

EXAMPLES 2–6

Compositions as in Table 2, within the scope of the invention, were prepared by mixing the ingredients in the order listed for each component.

TABLE 2

| Raw Material | % by weight of component |
|---|---|
| Surfactant Component | |
| Sodium Xylene Sulfonate | 10.33 |
| Propylene Glycol | 6.20 |
| Nonionic, Neodol ® 25-9 | 16.55 |
| Sodium Linear Alkyl Sulfonate | 18.90 |
| Sodium Ethoxylated Alcohol Sulfate (59.39%) | 16.55 |
| Miscellaneous | 0.72 |
| 1% Aqueous Dye Solution (TABLE 3) | As in TABLE 3 |
| Water to 100% | |
| Electrolyte Component | |
| Sodium Citrate | 36.50 |
| Sodium Carbonate | 2.19 |
| Colored Inorganic Electrolyte (TABLE 3) | As in TABLE 3 |
| Water | to 100% |
| Ionic Strength | 8.07 |

Colored inorganic electrolytes (from Fischer Scientific), as indicated in Table 3 were added to the electrolyte component as a solid and in the range of 1.0% –1.5%.

TABLE 3

| Example # | Amount of 1% dye solution added to the Surfactant Component % by weight of component | | Amount of Colored Inorganic Electrolyte, % by weight of the electrolyte layer | | Observations |
|---|---|---|---|---|---|
| 2 | Acid Blue 80 | 1.0 | Nickel Sulfate | 1.5 | Vivid blue surfactant layer and aquamarine electrolyte layer |
| 3 | D&C Green 8 | 0.5 | Nickel Sulfate | 1.5 | Yellowish surfactant layer with a vivid green electrolyte layer |
| 4 | Acid Blue 80 | 1.0 | Cupric Sulfate Pentahydrate | 1.0 | Vivid blue surfactant layer with turquoise electrolyte layer |
| 5 | Violet 2 | 0.9 | Cupric Sulfate Pentahydrate | 1.0 | Vivid blue surfactant layer with turquoise electrolyte layer |
| 6 | Green 8 | 0.5 | Cupric Sulfate Pentahydrate | 1.0 | Yellowish surfactant layer with a vivid green electrolyte layer (green dye partitioning into both layers) |

Fifty grams of formulation for each Example in Table 3 was heat-sealed in a PVA pouch made of MonoSol M-4045 PVA film. Two phases in different color tones in the pouch were vividly visible. After one month of storage at 25° C., the two phases were still stable and visible and the pouchs were still in a good condition.

What is claimed is:

1. A laundry detergent package for use in a single laundry application, the package comprising:

(a) a water-soluble body;

(b) a liquid laundry detergent composition contained within the water-soluble body for release upon the dissolution of the water-soluble body, the composition comprising:

at least two layers, said at least two layers comprising in total:

i. from about 5 to about 90% of a detergent surfactant; by weight of the composition;

ii. from about 5 to about 50% of a colored inorganic electrolyte, by weight of the composition; and iii. from about 1 to about 70% of water, by weight of the composition.

2. The package of claim 1, wherein the composition comprises at least about 10% total water.

3. The package of claim 1, wherein the water activity of the composition is less than about 0.94.

4. The package of claim 1, wherein the composition comprises from about 25% to about 70% of water, and wherein the water activity of the composition is less than about 0.94.

5. The package of claim 1, wherein the composition further comprises a hydrotrope.

6. The package of claim 1, wherein the composition further comprises a dye.

7. The package of claim 1, wherein the ionic strength of the electrolyte is at least 4.2.

8. The package of claim 1, wherein the detergent surfactant in the composition comprises a mixture of an anionic and a nonionic surfactant.

9. The package of claim 8, wherein the ratio of the anionic surfactant to the nonionic surfactant is from about 10:1 to about 1:10.

10. The package of claim 1, wherein the volume ratio of the first layer to the second layer is from about 10:90 to about 90:10.

11. The package of claim 1, wherein the water-soluble body is transparent.

12. The package of claim 1, wherein the composition is transparent.

13. The package of claim 1, further comprising a third layer.

14. The package of claim 13, wherein the third layer is a layer of capsules or emulsion.

15. A laundry detergent package for use in a single laundry application, the package comprising:

(a) a water-soluble body;

(b) a liquid laundry detergent composition contained within the water-soluble body for release upon the dissolution of the water-soluble body, the composition comprising:

at least two layers, said at least two layers comprising in total:

i. from about 5 to about 90% of a detergent surfactant; by weight of the composition;

ii. from about 1 to about 50% of total electrolyte, by weight of the composition, the electrolyte comprising a colored inorganic electrolyte and another electrolyte selected from the group consisting of an additional inorganic electrolyte, organic electrolyte, and mixtures threreof, and iii. from about 1 to about 70% of water, by weight of the composition.

16. The package of claim 15, wherein the total ionic strength of the electrolyte is at least 4.4.

17. The package of claim 15, wherein the composition further comprises a hydrotrope.

18. The package of claim 15, wherein the composition is transparent.

19. The package of claim 15, wherein the package is in the shape of tetrahedron.

20. A process of making a laundry detergent package comprising a layered liquid detergent composition for use in a single laundry application, the process comprising:

(a) preparing at least two liquid detergent components:

(a1) a first component comprising:

(a11) from about 5% to about 90%, by weight of the first component of a detergent surfactant;

(a12) from about 0 to about 60% by weight of the first component of total water (a13) from about 0 to about 15%, by weight of the first component of a colored inorganic electrolyte;

(a2) a second component comprising:

(a21) from about 2 to about 100%, by weight of the second component of a colored inorganic electrolyte;

(a22) from about 1 to about 90%, by weight of the second component of total water (a23) from about 0 to about 5% by weight of the second component of a detergent surfactant;

(b) filling the liquid components into a water-soluble body.

* * * * *